US005251975A

United States Patent [19]

Braun et al.

[11] Patent Number: 5,251,975

[45] Date of Patent: Oct. 12, 1993

[54] EXTENDABLE AND RETRACTABLE UNDERCOUNTER CONTAINER ASSEMBLY FOR RECYCLABLE MATERIALS

[76] Inventors: Thomas F. Braun; Manfred H. Braun, both of 250 Jackson Ave., Mineola, N.Y. 11501

[21] Appl. No.: 850,680

[22] Filed: Mar. 13, 1992

[51] Int. Cl.[5] ..... A47B 46/00

[52] U.S. Cl. ..... 312/334.16

[58] Field of Search ..... 312/334.16, 293.1, 319.1, 312/308, 273, 330.1, 334.5, 403, 348.4; 220/477

[56] References Cited

U.S. PATENT DOCUMENTS

| | | | |
|---|---|---|---|
| 1,018,490 | 2/1912 | Hall . | |
| 1,506,820 | 9/1924 | Erdman et al. . | |
| 2,312,185 | 2/1943 | Neunherz . | |
| 2,568,147 | 9/1951 | Fulton . | |
| 2,621,099 | 12/1952 | Lehman | 312/273 |
| 2,699,368 | 1/1955 | Selmer | 312/273 |
| 2,760,772 | 8/1956 | McIntryre . | |
| 3,204,866 | 9/1965 | Brighton et al. | 312/290 |
| 3,208,135 | 9/1965 | Newbold et al. . | |
| 3,333,555 | 8/1967 | Kapnek . | |
| 3,447,415 | 6/1969 | Kime . | |
| 3,528,718 | 9/1970 | Johnson et al. . | |
| 3,807,824 | 4/1974 | Hayes . | |
| 3,844,627 | 10/1974 | Gutner | 312/334.5 |
| 4,984,762 | 1/1991 | Braun et al. . | |
| 4,995,683 | 2/1991 | Albiez | 312/348.4 |

FOREIGN PATENT DOCUMENTS

| | | | |
|---|---|---|---|
| 2143426 | 2/1985 | United Kingdom | 312/348.4 |

*Primary Examiner*—James R. Brittain
*Assistant Examiner*—Janet M. Long
*Attorney, Agent, or Firm*—Jacobson, Price, Holman & Stern

[57] ABSTRACT

Containers or bins for recyclable materials mounted within a cabinet or in a space in underlying relation to a countertop for movement between an extended position in which the open tops of the bins or containers are exposed for receiving recyclable materials and a retracted position in which the bins are in concealed relation and closed by a unique top closing structure to form a generally airtight closure for the bins or containers The container assembly is supported for horizontal movement by a conventional drawer slide assembly with supporting brackets for the container assembly being connected to the stationary component forming a portion of the conventional slide assembly. The innermost or rear bracket is supported from the inner or rear wall of the cabinet or undercounter space and the outer or forward bracket is attached to a crossbar at a center point with the supporting structure enabling three degrees of adjustment of the slide assembly and bins or containers. The supporting assembly includes brackets on which a door can be mounted to form a closure for the undercounter space or cabinet in which the container assembly is mounted. The container assembly is constructed to enable easy removal of the bins or containers, easy mounting and assembly and quick and effective adjustment with all adjustments being securely locked when all components of the assembly are oriented in optimum adjusted position.

9 Claims, 3 Drawing Sheets

EXTENDABLE AND RETRACTABLE UNDERCOUNTER CONTAINER ASSEMBLY FOR RECYCLABLE MATERIALS

BACKGROUND OF THE INVENTION

1. Field of the Invention

The present invention generally relates to a container assembly for recyclable materials mounted within a cabinet or in a space oriented in underlying relation to a countertop for movement between an extended position in which the open tops of the bins or containers are exposed for receiving recyclable materials and a retracted position in which the bins are concealed and closed by a unique closure structure to automatically form a generally airtight closure for the bins or containers as they are moved horizontally to their retracted positions. The container assembly is supported for movement between its extended and retracted positions by a conventional drawer slide assembly with supporting brackets for the container assembly being connected to the stationary component of the conventional slide assembly. An innermost or rear bracket is supported from an inner or rear wall of the cabinet or undercounter space and an outer or forward bracket is attached to a crossbar forming the top edge of an opening in a front wall at a center point with the supporting structure enabling three degrees of adjustment of the slide assembly and bins or containers. The slide assembly includes brackets on which a door can be mounted for adjustment to accurately fit the opening in the front wall to form a closure for the undercounter space or cabinet in which the container assembly is mounted. The container assembly is constructed to enable easy removal of the bins or containers, easy mounting and assembly and quick and effective adjustment with all adjustments being securely locked when all components of the assembly are oriented in optimum adjusted position.

2. Description of the Prior Art

Our prior U.S. Pat. No. 4,984,762 issued Jan. 15, 1991 discloses a drawer slide frame secured in position by spring biased screw threaded structures to enable quick and easy installation of the inner or rear portion of a drawer slide frame. Prior U.S. Pat. No. 3,528,718 issued Sep. 1970 discloses a container that is mounted below a countertop or in a cabinet for movement between an extended and retracted position in which the container and movable support structure move in an inclined path. The prior art of record in the above two mentioned patents disclose various structural features relating to the inventions disclosed in the above mentioned patents and are made of record herein by reference thereto.

The prior art does not disclose the specific structure of the container assembly of the present invention including the supporting structure for the container assembly that provides ease of installation, accurate adjustment of the assembly in multiple planes, support structure for enabling extension and retraction of multiple bins or containers for recyclable material and a structure for providing a sealed closure for the bins or containers when moved in a horizontal path to retracted position. The prior art also fails to disclose the mounting of a door on the support structure for movement therewith with the door being in a normally closed position when the supporting structure and container assembly is in the retracted position.

SUMMARY OF THE INVENTION

An object of the present invention is to provide an extendable and retractable undercounter container assembly for recyclable materials which includes a pair of conventional drawer slide structures that are interconnected by a rear or inner bracket and a front or outer bracket connected with the slide assemblies to retain them in spaced parallel relation with the rear bracket being adjustably supported by a unique supporting and adjusting structure for supporting the rear bracket from the inner or rear wall of an undercounter space or cabinet with the front bracket being supported from a crossbar at the front of the undercounter space or cabinet.

Another object of the invention is to provide a container assembly for recyclable material in which the movable components of the drawer slide assemblies support a pair of bins or receptacles for receiving recyclable materials with the upper ends of the bins or containers being exposed and accessible when moved to an extended position to provide access thereto in order to enable categorized recyclable materials to be placed in the bins.

A further object of the invention is to provide a container assembly in accordance with the preceding objects in which the stationary component and the movable component are provided with inclined surfaces which come into sealing contact with each other when the container assembly is moved horizontally to its retracted position thereby preventing the passage of insects, rodents and the like and also forming a seal for the containers or bins to reduce or eliminate passage of odors from the interior of the bins or containers into the undercounter space, cabinet or kitchen in which the invention is mounted.

Still another object of the invention is to provide a container assembly in accordance with the preceding objects in which the front or outer ends of the slide assemblies are provided with brackets to adjustably connect a door which forms a closure for the cabinet or undercounter space with the door being in proper registry with a door opening which provides access to the container assembly and which, when in closed position, will be properly oriented in registry with a door opening and other doors in a cabinet assembly or undercounter cabinet assembly.

A still further object of the invention is to provide a container assembly in accordance with the preceding objects in which the rear bracket is spring biased toward the front of the undercounter space or cabinet and the outer or front bracket is attached to a crossbar by a headed screw having the shank received in a T-shaped slot with the rear bracket being spring biased outwardly to spring bias the outer bracket towards the headed screw to retain the rear and front brackets in mounted position between the rear wall of the cabinet or undercounter space and the crossbar at the front of the undercounter space or cabinet thereby greatly facilitating mounting of the container assembly in position with the adjustment enabling accurate orientation of the containers and bins and accurate orientation of the cabinet door in relation to the cabinet opening whether the cabinet be an undercounter cabinet or a freestanding cabinet thereby maintaining the container assembly in readily accessible position for receiving recyclable materials.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
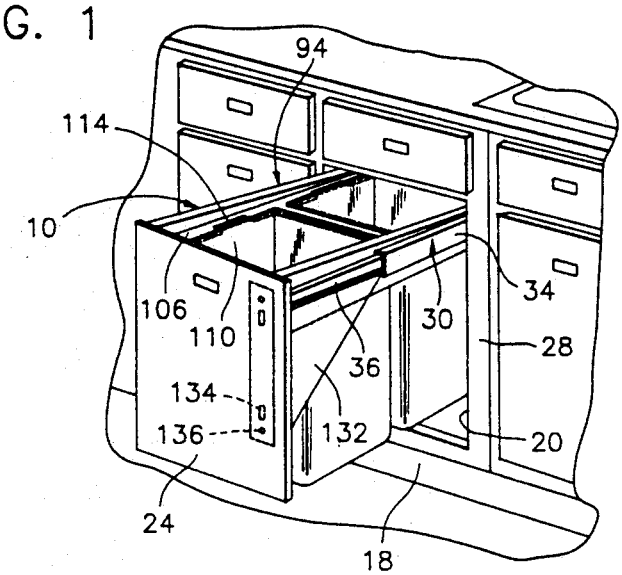
FIG. 1 is a perspective view of the extendable and retractable container assembly for recyclable materials of the present invention illustrating the container assembly in extended position.
Figure 2:
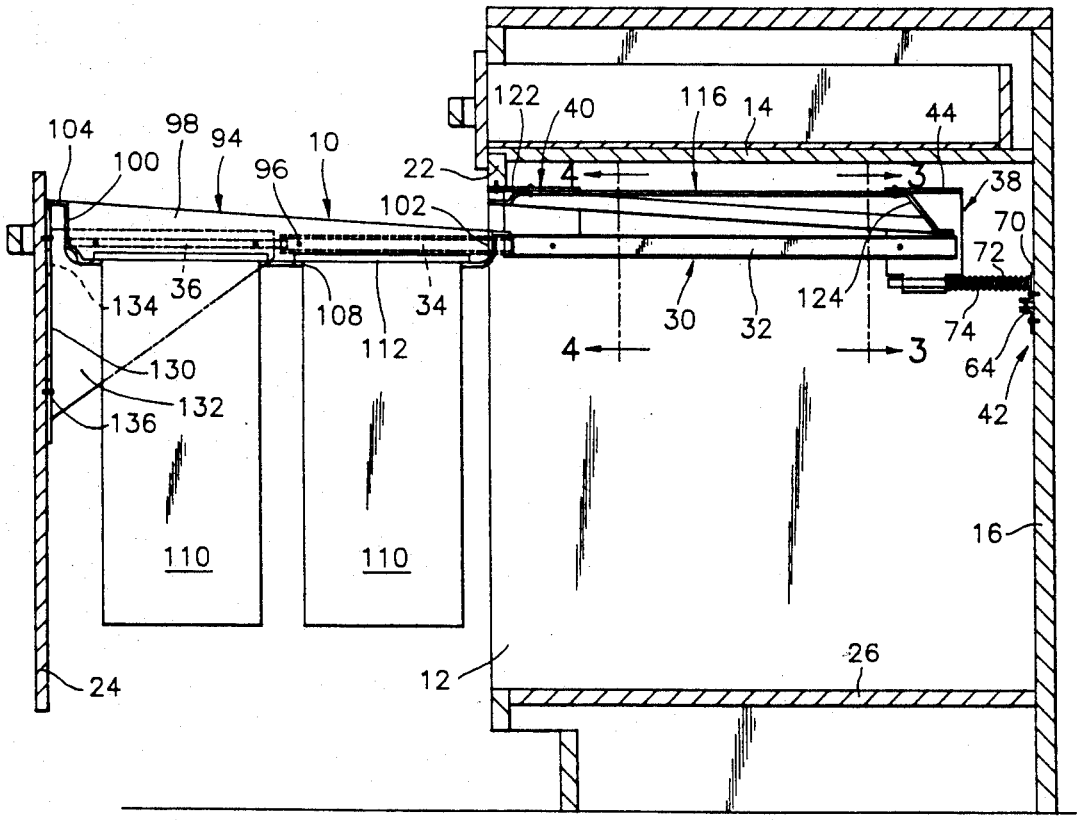
FIG. 2 is a longitudinal, sectional view of the container assembly illustrating the structural details of the brackets, supporting slides, the closure members and the bins or containers and door.
Figure 3:
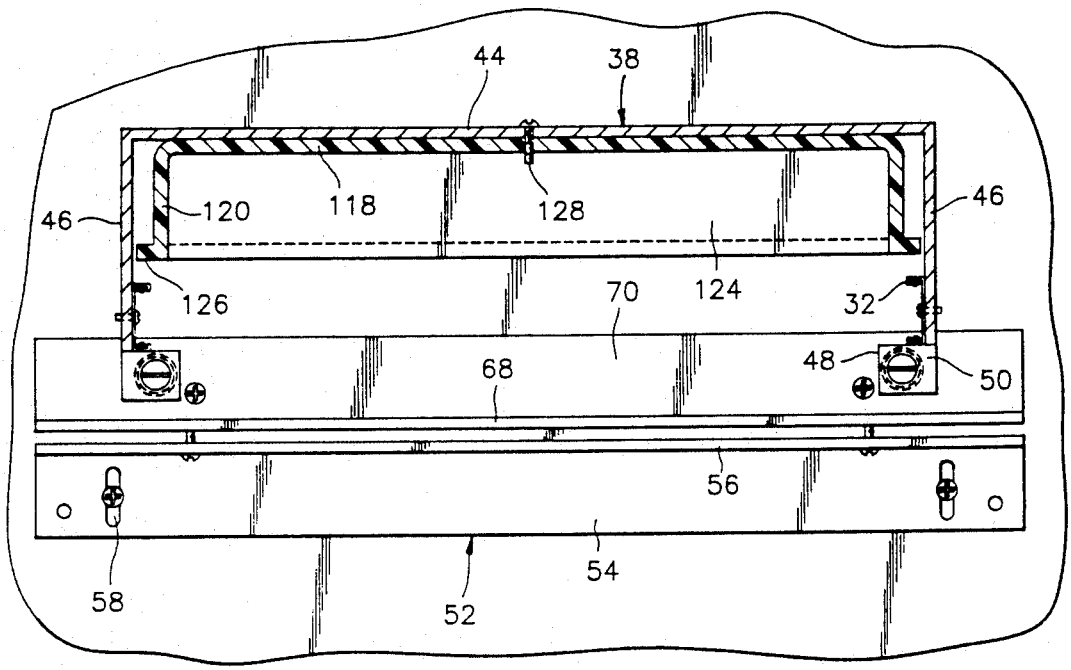
FIG. 3 is a transverse, sectional view taken along section line 3—3 on FIG. 2 illustrating the rear mounting bracket and support components therefor attached to the rear wall of the undercounter space.
Figure 4:
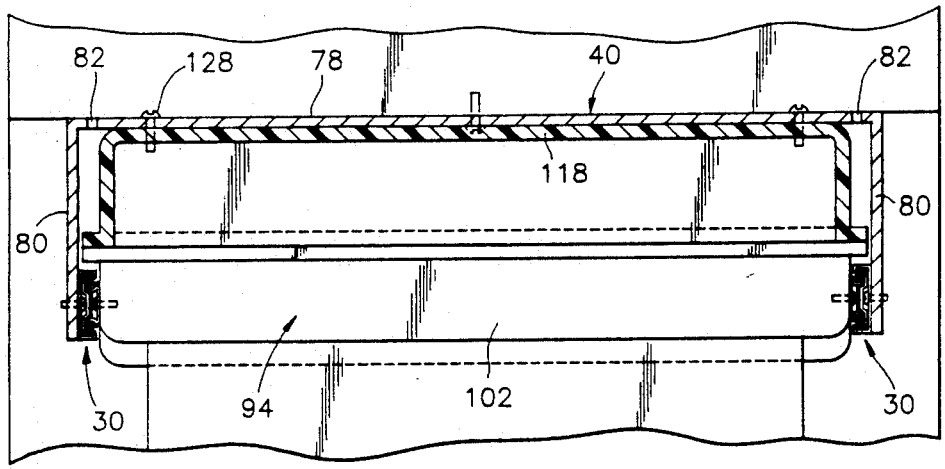
FIG. 4 is a transverse, sectional view taken substantially upon a plane passing along section line 4—4 on FIG. 2 illustrating further structural details of the forward mounting bracket and the manner in which it is attached to the crossbar at the front of the or undercounter space.
Figure 5:
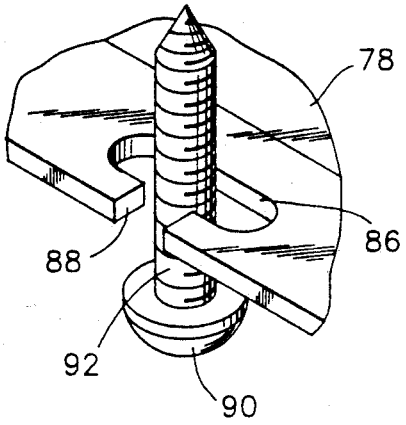
FIG. 5 is a perspective view of the front mounting bracket.
Figure 6:
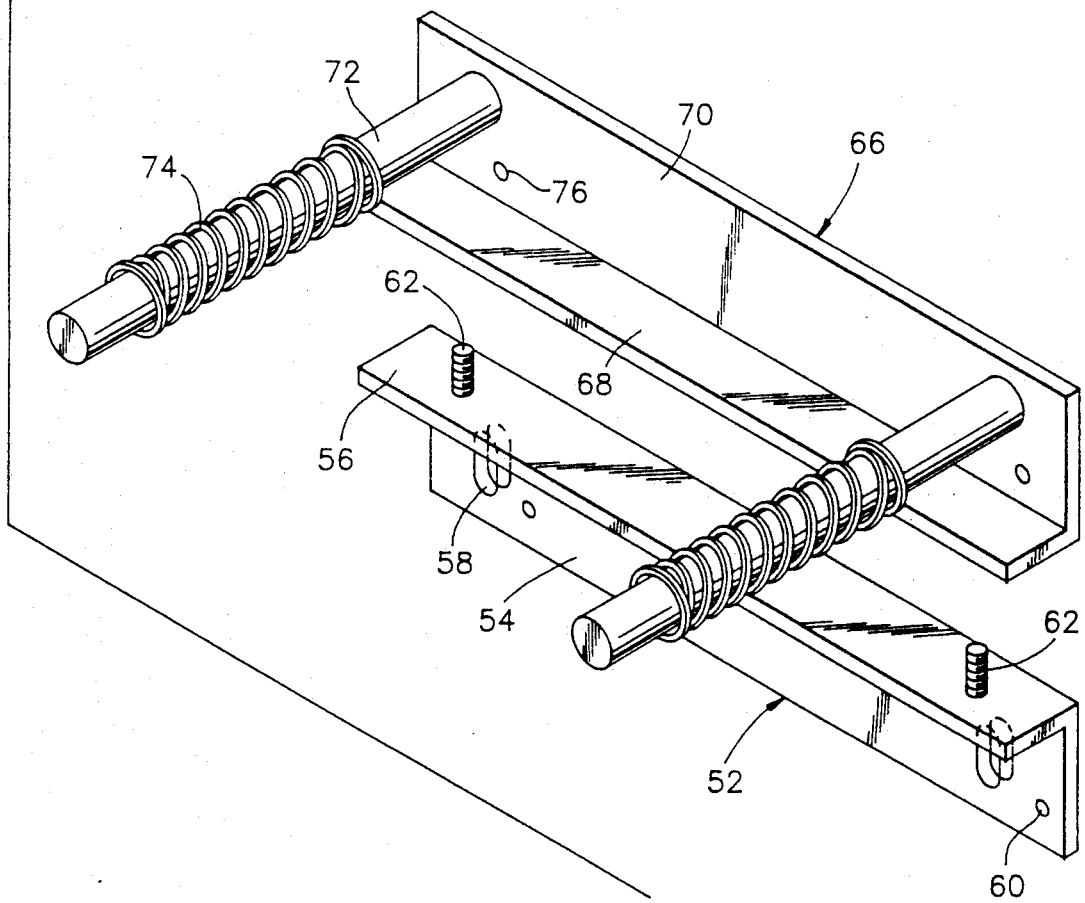
FIG. 6 is an exploded group perspective view of the components of the mounting structure for the rear mounting bracket.

Referring to the drawings, the container assembly is designated by reference numeral 10 and is supported in an undercounter space or cabinet 12 provided with a top wall 14, a rear wall 16, a front wall 18 with an opening 20 therein which has a crossbar 22 forming the upper edge thereof with a door 24 normally closing the opening and being associated with a bottom floor 26 and side edges 28 defined by vertical members. The door 24 is a conventional door and would normally be mounted by hinges on one side edge 28 in order to open and close the door. When the present invention is mounted therein, the door hinges are removed and the door is attached to the container assembly 10 for movement between extended and retracted positions with the door being accurately aligned with and in registry with the opening 20 when in the retracted position so that the undercounter cabinets look the same as if the door 24 was hinged at one side.

The assembly 10 includes a pair of horizontally disposed, elongated slide supports 30 which ar conventional structures that are used as drawer slides which include three components 32, 34 and 36 with the stationary component being designated by reference numeral 32 and being mounted within the space 12 between the rear wall 16 and the crossbar 22 by the use of a rear bracket generally designated by reference numeral 38 and a front bracket generally designated by reference numeral 40. A support assembly 42 for the rear bracket 38 adjustably supports the rear bracket 38 from the rear wall 16 and the front bracket 40 is supported from the crossbar 22 as set forth hereinafter.

The rear bracket 38 includes a transversely extending rigid plate 44 fixedly attached to the stationary component 32 of the slide support 30 by riveting, spot welding or the like to provide a permanent connection. The ends of the plate 44 are downturned as at 46 alongside of the slide support 30 and terminate at a bottom edge portion 48 with inturned apertured ears or lugs 50 oriented in front-to-rear aligned relation.

The support assembly 42 includes a horizontally disposed angle iron member generally designated by reference numeral 52 and including a vertical flange 54 and a horizontal flange 56. The vertical flange 54 is attached to the rear wall 16 by virtue of vertical slots 58 and screw receiving holes 60 in a manner described hereinafter. The horizontal flange 56 which extends forwardly from the rear wall includes a pair of screw threaded members 62 extending upwardly through the flange 56 and screw threadedly engaged therewith at 64 with nuts being welded to the undersurface of the flange 56 to provide threaded support for the screws 62. The support assembly 42 also includes an upper right angled member generally designated by reference numeral 66 which is horizontally disposed and includes a horizontal flange 68 overlying and in alignment with the flange 56 and being supported by the upper ends of the adjustment screws 62. The angle iron member 66 includes a vertical flange 70 adjacent the rear wall 16 and having a pair of elongated guide rods 72 rigidly affixed thereto and extending forwardly therefrom in parallel spaced relation with the rods 72 being received in the apertured guide ears 50 or lugs on the rear bracket 38 as illustrated in the drawings. The end of each rod 72 is rigidly connected to the flange 70 by a rolled connection to permanently and rigidly connect the rod 72 to the flange 70 in perpendicular relation thereto. A coil compression spring 74 is positioned on each of the rods 72 and the ends of the springs abut the flange 70 and the rearmost guide ear or lug 50 which biases the rear bracket 38 towards the front of the undercounter space 12. Also, the flange 70 is provided with apertures 76 used to receive retaining screws after all of the components have been properly adjusted in a manner described hereinafter.

The front bracket 40 includes a transverse top plate 78 having downturned edge flanges 80 alongside the stationary component 32 of the slide support 30. The front edge of the plate 78 is provided with screw openings 82 adjacent each side thereof. At the center, the top plate 78 is provided with a T-shaped slot 86 having an entrance slot 88 in communication with the front edge of the top plate 78. The T-shaped slot 86 cooperates with a headed screw 90 having a reduced shank 92 screw threaded into the crossbar 22 to support the front bracket 40 from the crossbar. This is obtained by forcing the assembled slide supports 30, rear bracket 38 and front bracket 40 onto the support assembly 42 by engaging the ears or lugs 50 with the rods 72 and forcing the assembly to the rear for compressing the springs 74 until, the front edge of the top plate 78 passes beyond the headed screw 90 at which time the front bracket 40 is elevated and pressure released to enable the shank 92 to enter the slot 88 and be received in the T-shaped slot 86. The container assembly will hold itself up as the spring pressure retains the assembled brackets 38 and 40 and the slide supports 30 mounted in the space 12. Adjustment by rotating either or both of the screws 62 then may be carried out to vary the elevation and the angular relation of the right angle member 66 thus varying the position of the rods 72 and the brackets,. and slide supports. The shank 92 enables the front bracket 40 to be laterally adjusted within the limits of the length of the T-shaped slot 86, thus providing multiple adjustments for the slide supports and container assembly.

The movable components 34 and 36 of the slide supports 30 support a longitudinally extending tray structure 94 therefrom which is attached thereto by fasteners 96 in the side walls 98 of the tray 94 which includes a relatively high front wall 100 and a relatively low rear wall 102 to form an inclined top edge on the side walls 98 with the entire periphery of the tray having a peripheral flange 104 thereon. The tray includes a bottom 106 having two large openings 108 therein of square or rectangular configuration through which a bin or container 110 is dropped and supported therefrom by a peripheral outwardly projecting flange 112 at the upper end of the bin or container 110. The peripheral edge of the opening 108 is closely associated with and usually contacts the external surface of the bin 110 with the flange 112 resting against the upper surface of the bottom or floor 106 of the tray. The bottom 106 of the tray at opposite side edges of the openings 108 have a recess 114 formed therein which does not go all the way through to the bottom surface of the bottom 106 of the tray thus providing an area in which the fingers can be inserted under the flanges 112 to lift and handle the bin or container when removing or replacing the bin or container in the opening 108.

The rear bracket and front bracket support a lid generally designated by reference numeral 116 in the form of an inverted tray having a top,, wall 118, depending side walls 120, a relatively short front wall 122 and a relatively long rear wall 124 to form a generally wedge-shaped lid 116 for the tray 94 with the lower edges of the walls being defined by an outwardly extending flange 126 which will engage and contact the flange 104 on the periphery of the tray 94 thus forming a sealed closure for the bins or receptacles 110 with an optional O-ring or other resilient sealing material being placed on the flange if desired. The lid 116 is supported from the rear and front brackets by fasteners 128 and is positioned within the slide supports in order for the movable portions of the slide supports to move horizontally in relation to the horizontal stationary portion in a conventional manner with the inclined upper edge of the lower tray 94 coming into contact with and engaging the flange on the bottom edge of the lid 116 when the movable portions of the slide supports are moved inwardly to their rearmost position which is defined by the sealing engagement between the tray and lid.

The movable segment 36 of the slide supports are provided with vertical brackets 130 at their outer ends with a gusset 132 reinforcing and supporting the brackets 130. The brackets 130 are provided with vertical slots 134 receiving fasteners and apertures 136 receiving fasteners to support the door 24 from the slide supports 30 with the slots 134 enabling vertical adjustment of the door in relation to the brackets 130 and the openings 136 receiving screws to lock the door in its final adjusted position in relation to the slide supports and door opening 20.

When installing the container assembly, the rear bracket 38 and the front bracket 40 are rigidly and fixedly attached to the stationary portions 32 of the slide support 30 and the lid 116 which is preferably constructed of molded plastic material is attached to the brackets 38 and 40. The right angle bracket 52 is then attached to the rear wall 16 by fasteners extending through the vertical slots 58. The right angle member 66 with the rod 72 and springs 74 thereon are inserted through the apertured ears or lugs 50 and this assembly is then positioned in the undercounter space 12 with the flange 68 of the right angle bracket 66 resting on the adjustable screws 62. Inward force is then exerted on the assembly until the outer edge of the plate 78 clears the headed screw 90 which has been previously inserted into the crossbar 22 with the front mounting bracket then being elevated slightly to register the shank 92 with the slot 88 so the shank 92 can enter the T-shaped slot 86 when inward pressure on the assembly is released. The compression of the springs 74 retains the right angled member 66 against the rear wall 16 and in overlying relation to the adjustment screws 62 and retains the shank 92 of the headed fastener 90 in the T-shaped slot 86. This structure enables the vertical elevation of the rear ends of the slide supports and container assembly to be adjusted by rotating the screws 62 and permits angular adjustment by rotating only one of the screws or rotating the screws in opposite directions with this adjustment being enabled by the single point of support from the headed fastener 90 at the front end of the front bracket 40. The lateral extent of the T-shaped slot 86 also enables the front end of the slide supports 30 to be adjusted laterally in relation to the opening to properly position the slide supports 30 and door 24 in relation to the door opening 20. The door itself can be vertically adjusted to provide a final adjustment with respect to the door opening and after all of the components are in their accurately adjusted position, fasteners can be inserted through the openings 60 in the flange 54 to lock the right angle member 52 in place, inserted through openings 76 in the flange 70 of the right angle member 66 to secure it in adjusted position, through the openings 82 in the front bracket 40 to secure it in adjusted position and through the openings 136 in the bracket 130 to secure the door in adjusted position thus facilitating the accurate positioning of the components. This enables the slide supports 30 to function in their normal manner when moving the tray 94 and bins or containers supported therefrom inwardly and outwardly along with the door. Engagement of the tray 94 with or separation from the lid 116 provides a seal for the bins by merely moving the tray and door horizontally. This structure provides a readily mountable and accessible multiple container or bin assembly for receiving various recyclable materials and maintaining the recyclable materials in a confined space impervious to insects, rodents and being substantially sealed against passage of air, odors and the like. The door and its supporting structure may be omitted in some installations and one or more bins may be supported from the tray 94.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A container assembly for recyclable material comprising a pair of slide supports, means mounting said slide supports in a space defined by an inner rear wall and an outer front wall, each of said slide supports including a stationary component connected with the mounting means and a movable component to move through an opening in said front wall, container means supported from said movable component for movement between an extended position oriented outwardly of the front wall to a retracted position inwardly of the front wall, said container means including an open upper end through which recyclable material may be positioned when the movable component and container means are in extended position, said means mounting the slide supports in said space also including a rear mounting bracket rigidly attached to the slide supports and a front mounting bracket rigidly attached to the slide supports, means detachably and adjustably connecting the rear bracket to the rear wall and means detachably and adjustably connecting the front bracket to an upper edge of said opening in the front wall, said means connecting the rear bracket to the rear wall including a pair of horizontally disposed support members oriented in superimposed relation to each other with a lower support member being adjustably connected to the rear wall, an upper support member resting on the lower support member, said upper support member including a pair of guide rods rigidly connected therewith, said rear bracket including apertured lug means slidably receiving the guide rods, spring means on said guide rods between the lug means and the upper support member to bias the upper support member against the rear wall to retain the upper support member in overlying engagement with the lower support member.

2. The container assembly as defined in claim 1 wherein said means supporting the front bracket from the front wall includes a crossbar defining the top of the opening in the front wall, a headed screw inserted into the undersurface of the crossbar with the headed screw having a reduced shank and a head with the head being spaced below the crossbar, said front bracket including a T-shaped notch communicating with the front edge of the front bracket and receiving the shank of the headed screw therein when the slide supports and mounting brackets are moved inwardly to compress the spring means on the guide rods with the spring means biasing the slide supports and brackets toward the front wall to retain the T-shaped slot in the front bracket in engagement with the shank of the screw with the head of the screw supporting the front bracket, said T-shaped slot enabling the front bracket to move laterally in relation to the screw and front opening within the limits of the T-shaped slot.

3. The container assembly as defined in claim 2 wherein the lower support member mounted on the rear wall includes laterally spaced screw threaded members extending upwardly therethrough for engagement with the upper support member to vertically adjust the upper support member and the rear mounting bracket and the rear ends of the slide support and to angularly adjust the upper support member and the rear mounting bracket and the slide supports connected thereto.

4. The container assembly as defined in claim 3 wherein the outer end of the movable component of each slide support includes a vertical bracket, means adjustably connecting the vertical bracket to an inner surface of a door forming a closure for the opening in said front wall.

5. The container assembly as defined in claim 1 wherein the outer end of the movable component of each slide support includes a vertical bracket, means adjustably connecting the vertical bracket to an inner surface of a door forming a closure for the opening in said front wall.

6. The container assembly as defined in claim 1 wherein the movable component of said slide supports includes a tray supported therein, said tray including enlarged apertures, said container means including a pair of containers having a peripheral outwardly extending flange at the upper end thereof with the containers being dropped through the openings in the tray and the flanges supported from the tray peripherally of the openings to enable removal and replacement of the containers.

7. The container assembly as defined in claim 6 wherein said means mounting the stationary component includes a downwardly facing lid having a peripheral edge inclined upwardly from the rear to the front of the space, said tray including an upwardly extending peripheral edge inclined upwardly from the rear edge to the front edge for sealing contact with the lid when the container means is in retracted position thereby preventing passage of insects, rodents and odor.

8. A container assembly for recyclable material comprising a pair of slide supports, means mounting said slide supports in a space defined by an inner rear wall and an outer front wall, each of said slide supports including a stationary component connected with the mounting means and a movable component to move through an opening in said front wall, container means supported from said movable component for movement between an extended position oriented outwardly of the front wall to a retracted position inwardly of the front wall, said container means including an open upper end through which recyclable material may be positioned when the movable component and container means are in extended position, said means mounting said slide supports in said space including a first rear support for support from said rear wall in stationary position thereon, a second rear support for butting said rear wall and disposed in vertically spaced relation relative to said first rear support, adjustment means operatively associated with said first and second rear supports for height adjustment and angular adjustment in the plane of said rear wall of said second rear support relative to said first rear support, said slide supports including rear ends supported from said second rear support.

9. The container assembly as defined in claim 8 wherein said second rear support includes a pair of forwardly projecting rods supported therefrom having compression springs slidably disposed thereon, the rear ends of said slide supports including sleeves telescoped over said rods and partially compressing said springs, said means mounting said slide supports in said space also including a front mounting bracket spanning between and supporting the front ends of said slide supports, said front mounting bracket including a forwardly facing flange having a T-slot formed therein opening forwardly through said flange and adapted to receive the shank of a headed screw therethrough adapted to be threaded upwardly into the portion of said front wall defining the upper margin of said opening in said front wall.

* * * * *